US006155416A

United States Patent [19]

Jaime

[11] Patent Number: 6,155,416

[45] Date of Patent: Dec. 5, 2000

[54] REMOTE CAR ALARM PROTECTIVE DEVICE

[76] Inventor: Martin Jaime, 5519 Sun La., Bell Gardens, Calif. 90201

[21] Appl. No.: 09/285,188

[22] Filed: Mar. 31, 1999

[51] Int. Cl.[7] ..... B65D 85/38

[52] U.S. Cl. ..... 206/305; 206/320; 206/37

[58] Field of Search ..... 206/305, 320, 206/37, 37.5; 220/345.1, 345.3, 837

[56] References Cited

U.S. PATENT DOCUMENTS

| | | | |
|---|---|---|---|
| 3,412,890 | 11/1968 | Rich | 206/837 |
| 3,417,897 | 12/1968 | Johnson | 206/837 |
| 3,884,641 | 5/1975 | Kraffczyk et al. | 206/305 |
| 4,259,568 | 3/1981 | Dynesen | 206/305 |
| 4,314,637 | 2/1982 | Posso | 206/320 |
| 4,836,256 | 6/1989 | Meliconi | 206/305 |
| 5,002,197 | 3/1991 | Ponsi | 220/837 |
| 5,064,088 | 11/1991 | Steffes | 220/339 |
| 5,388,691 | 2/1995 | White | 206/305 |
| 5,560,481 | 10/1996 | Doodson et al. | 206/387.1 |
| 5,678,204 | 10/1997 | Naylor | 206/305 |

*Primary Examiner*—Paul T. Sewell
*Assistant Examiner*—Shian Luong
*Attorney, Agent, or Firm*—Goldstein & Canino

[57] ABSTRACT

A remote car alarm protective device comprised of a protective housing adapted for covering a remote transmitter for a car alarm. The protective housing will prevent the remote transmitter from being damaged when dropped or otherwise made contact with.

2 Claims, 2 Drawing Sheets

REMOTE CAR ALARM PROTECTIVE DEVICE

BACKGROUND OF THE INVENTION

The present invention relates to a remote car alarm protective device and more particularly pertains to protecting a remote car alarm from being damaged and accidently disarming a car alarm.

Most vehicles today, especially newer vehicles, are equipped with an alarm system to prevent the theft of the vehicle or the prevent a thief from breaking into the vehicle to steal valuables from inside of the vehicle. Most of the alarm systems are provided with a remote transmitter that allows the vehicle owner to activate or deactivate the alarm from a relatively short distance away from the car. Most of these remote transmitters are small enough to be carried in the vehicle owner's pocket, possibly attached to their key chain. The remote transmitters are generally constructed of with a plastic housing that easily susceptible to being damaged. The problem associated with carrying the remote transmitter in the pocket and attached to the key chain is that people tend to drop their key chain by accident or throw the key chain onto a stationary storage area. These actions will often result in the remote transmitter becoming damaged, particularly the breaking of the plastic housing damaging the critical components that remotely operate the car alarm.

The present invention attempts to solve these problems by providing a device that will protect the remote transmitter while at the same time allow easy access to the function buttons that serve to activate and deactivate the vehicles alarm system.

The use of covers for portable electronic devices is known in the prior art. More specifically, covers for portable electronic devices heretofore devised and utilized for the purpose of providing protection are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,388,691 to White discloses a ridged protective casing for a remote control transmitter with a clear plastic cover. U.S. Pat. No. 5,678,204 to Naylor discloses a protective cover for a transmitter with means to cover the control buttons.

While these devices fulfill their respective, particular objective and requirements, the aforementioned patents do not describe a remote car alarm protective device for protecting a remote car alarm from being damaged and accidently disarming a car alarm.

In this respect, the remote car alarm protective device according to the present invention substantially departs from the conventional concepts and designs of the prior art, and in doing so provides an apparatus primarily developed for the purpose of protecting a remote car alarm from being damaged and accidently disarming a car alarm.

Therefore, it can be appreciated that there exists a continuing need for new and improved remote car alarm protective device which can be used for protecting a remote car alarm from being damaged and accidently disarming a car alarm. In this regard, the present invention substantially fulfills this need.

SUMMARY OF THE INVENTION

In the view of the foregoing disadvantages inherent in the known types of covers for portable electronic devices now present in the prior art, the present invention provides an improved remote car alarm protective device. As such, the general purpose of the present invention, which will be described subsequently in greater detail, is to provide a new and improved remote car alarm protective device and method which has all the advantages of the prior art and none of the disadvantages.

To attain this, the present invention essentially comprises a protective housing adapted for covering a remote transmitter for a car alarm. The protective housing is comprised of a first section and a second section hingedly coupled together along interior edges thereof. The first section covers function buttons of an upper portion of the remote transmitter whereas the second section is fixedly coupled to a lower portion of the remote transmitter. The first section and the second section each have a main panel with downwardly extending opposed side walls. The first section has a downwardly extending top wall for covering an upper end of the remote transmitter. The side walls of the second section each have inwardly extending projections on lower ends thereof whereby the protective housing can be slidably received on the remote transmitter.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved remote car alarm protective device which has all the advantages of the prior art covers for portable electronic devices and none of the disadvantages.

It is another object of the present invention to provide a new and improved remote car alarm protective device which may be easily and efficiently manufactured and marketed.

It is a further object of the present invention to provide a new and improved remote car alarm protective device which is of durable and reliable construction.

An even further object of the present invention is to provide a new and improved remote car alarm protective device which is susceptible of a low cost of manufacture with regard to both materials and labor, and which accordingly is then susceptible of low prices of sale to the consuming public, thereby making such a remote car alarm protective device economically available to the buying public.

Even still another object of the present invention is to provide a new and improved remote car alarm protective device for protecting a remote car alarm from being damaged and accidently disarming a car alarm.

Lastly, it is an object of the present invention to provide a new and improved remote car alarm protective device including a protective housing adapted for covering a remote transmitter for a car alarm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, and in particular, to FIGS. 1 through 4 thereof, the preferred embodiment of the new and improved remote car alarm protective device embodying the principles and concepts of the present invention and generally designated by the reference number 10 will be described.

Specifically, it will be noted in the various Figures that the device relates to a remote car alarm protective device for protecting a remote car alarm from being damaged and accidently disarming a car alarm.

Figure 1:
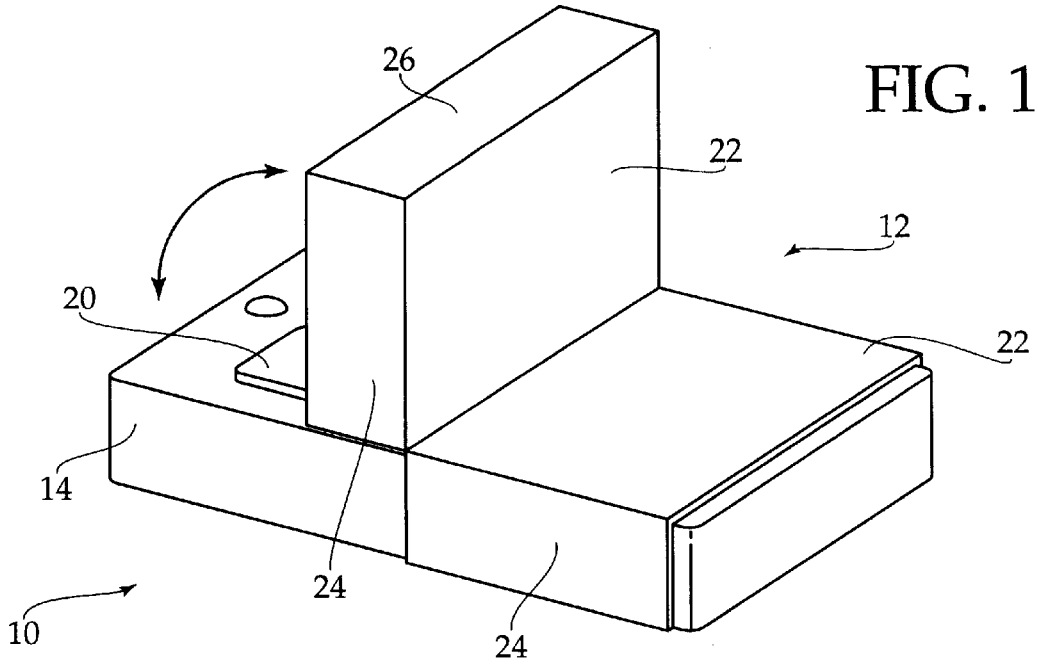
FIG. 1 is a perspective view of the preferred embodiment of the remote car alarm protective device constructed in accordance with the principles of the present invention.
Figure 2:
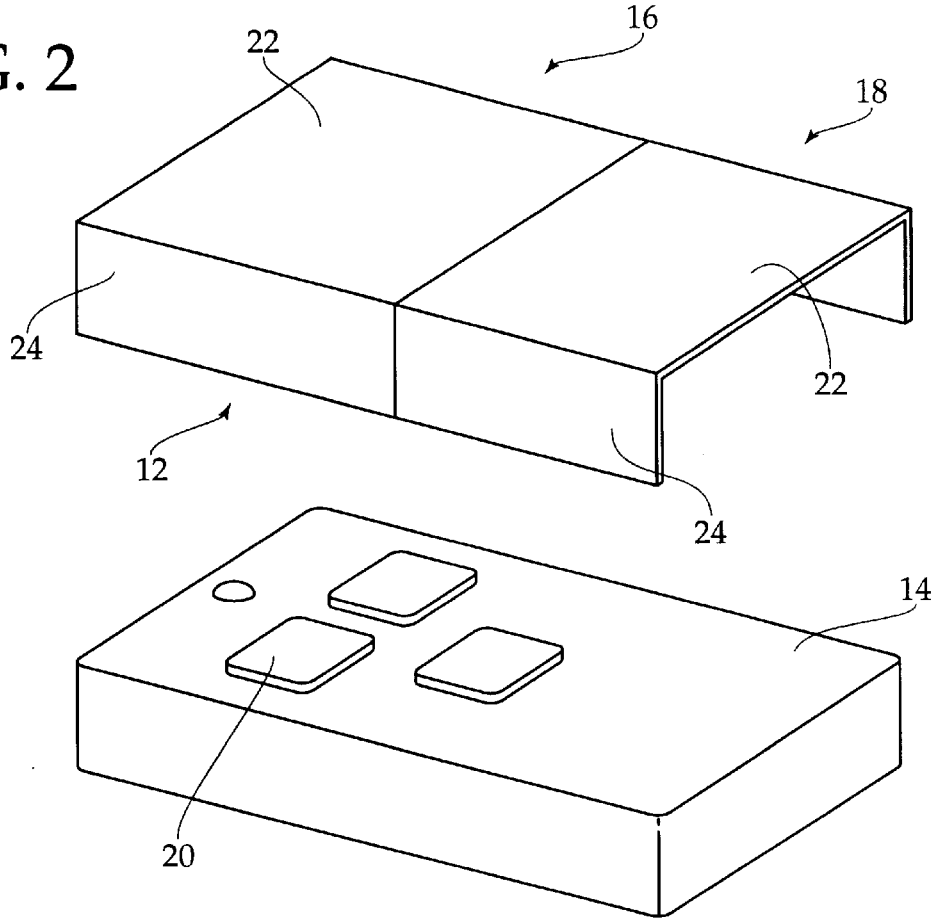
FIG. 2 is a perspective view of the preferred embodiment of the present invention illustrated removed from the car alarm remote.
Figure 3:
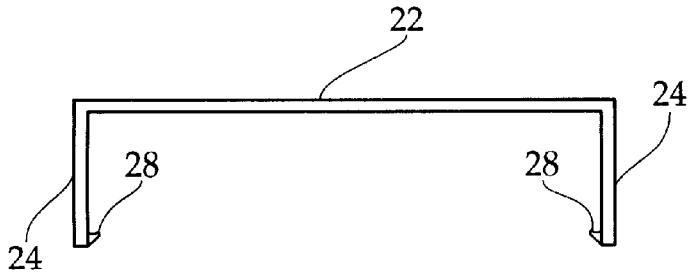
FIG. 3 is an end view of the preferred embodiment of the present invention.

A protective housing 12, as illustrated in FIGS. 1 through 3, is adapted for covering a remote transmitter 14 for a car alarm. The protective housing 14 is comprised of a first section 16 and a second section 18 hingedly coupled together along interior edges thereof. Note FIG. 1. The first section 16 covers function buttons 20 of an upper portion of the remote transmitter 14 whereas the second section 18 is fixedly coupled to a lower portion of the remote transmitter 14. Thus, when the user wants to gain access to the function buttons 20, he/she will simply lift upwardly on the first section 16 causing it to pivot upwardly with respect to the second section 18 thereby allowing the user access to the function buttons 20. The first section 16 and the second section 18 each have a main panel 22 with downwardly extending opposed side walls 24. The first section 16 has a downwardly extending top wall 26 for covering an upper end of the remote transmitter 14. The side walls 24 of the second section 18 each have inwardly extending projections 28 on lower ends thereof whereby the protective housing 12 can be slidably received on the remote transmitter 14. Note FIG. 3.

Figure 4:
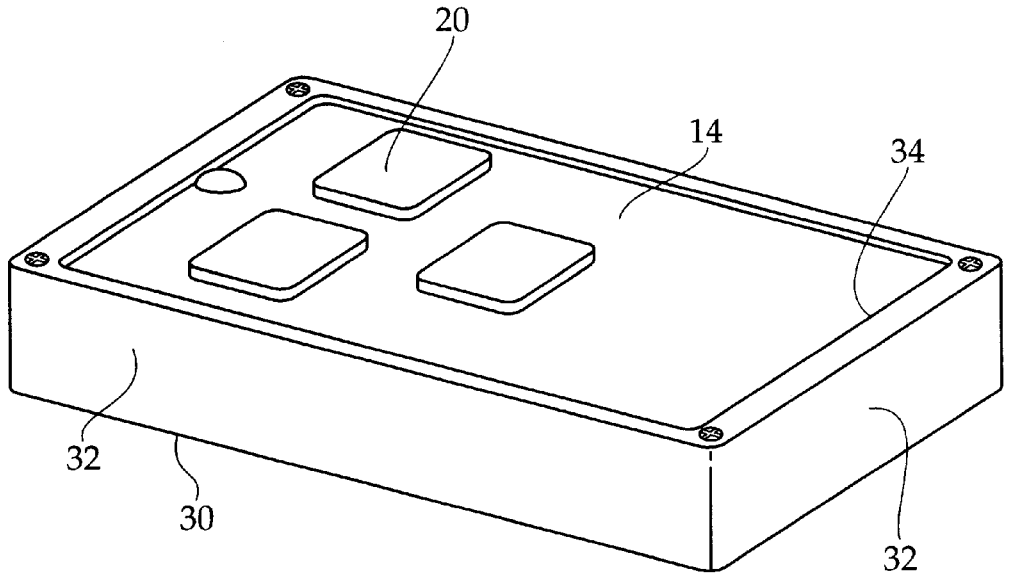
FIG. 4 is a perspective view of a second embodiment of the present invention.

A second embodiment of the present invention is shown in FIG. 4 and includes substantially all of the components of the present invention further including that the protective housing 12 is comprised of a lower panel 30 having a peripheral side wall 32 extending upwardly therefrom whereby the remote transmitter 14 is positioned on the lower panel 30 with the peripheral side wall 32 surrounding the remote transmitter 14. The peripheral side wall 32 has inwardly extending upper edges 34 to prevent the remote transmitter 14 from becoming removed from the protective housing. In this embodiment, the protective housing 12 has an open top face to allow access to the function buttons 20 without having to move any parts. For remote transmitters having a crystal transmitter on the front end of the unit, the peripheral side wall 32 will have an opening to accommodate such a variance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A remote car alarm protective device for protecting a remote car alarm from being damaged and accidently disarming a car alarm comprising, in combination:

a protective housing adapted for covering a remote transmitter for a car alarm, the protective housing being comprised of a first section and a second section hingedly coupled together along interior edges thereof, the first section covering function buttons of an upper portion of the remote transmitter whereas the second section is fixedly coupled to a lower portion of the remote transmitter, the first section and the second section each having a main panel with downwardly extending opposed side walls, the first section having a downwardly extending top wall for covering an upper end of the remote transmitter, the side walls of the second section each having inwardly extending projections on lower ends thereof whereby the protective housing can be slidably received on the remote transmitter.

2. A remote car alarm protective device for protecting a remote car alarm from being damaged and accidently disarming a car alarm comprising, in combination:

a protective housing adapted for covering a remote transmitter for a car alarm, said housing comprising a first section and a second section hingedly coupled together along interior edges thereof, the first section covering function buttons of an upper portion of the remote transmitter whereas the second section is fixedly coupled to a lower portion of the remote transmitter;

whereas the first section and the second section each have a main panel with downwardly extending opposed side walls, the first section having a downwardly extending top wall for covering an upper end of the remote transmitter, and the side walls of the second section each have inwardly extending projections on lower ends thereof whereby the protective housing can be slidably received on the remote transmitter.

* * * * *